US006055970A

United States Patent [19]

Takahashi

[11] Patent Number: 6,055,970

[45] Date of Patent: May 2, 2000

[54] CONTROL SYSTEM FOR AN OUTBOARD MOTOR

[75] Inventor: Masanori Takahashi, Hamamatsu, Japan

[73] Assignee: Sanshin Kogyo Kabushiki Kaisha, Japan

[21] Appl. No.: 08/957,253

[22] Filed: Oct. 24, 1997

[51] Int. Cl.[7] ..... F02D 41/14

[52] U.S. Cl. ..... 123/672; 123/673; 123/691

[58] Field of Search ..... 123/672, 691, 123/673, 195 HC, 196 W, 317; 440/89

[56] References Cited

U.S. PATENT DOCUMENTS

| | | | |
|---|---|---|---|
| 5,199,408 | 4/1993 | Wataya | 123/673 |
| 5,251,602 | 10/1993 | Kurihara et al. . | |
| 5,271,480 | 12/1993 | Takegami . | |
| 5,337,722 | 8/1994 | Kurihara et al. . | |
| 5,474,053 | 12/1995 | Suzuki . | |
| 5,529,048 | 6/1996 | Kurihara et al. . | |
| 5,535,135 | 7/1996 | Bush et al. | 123/672 |
| 5,546,919 | 8/1996 | Iida et al. . | |
| 5,554,060 | 9/1996 | Koishikawa et al. | 440/89 |
| 5,562,510 | 10/1996 | Suzuki et al. | 440/89 |
| 5,584,281 | 12/1996 | Katoh . | |
| 5,588,416 | 12/1996 | Suzuki et al. . | |
| 5,613,480 | 3/1997 | Katoh et al. . | |
| 5,615,661 | 4/1997 | Suzuki . | |
| 5,637,792 | 6/1997 | Kimura et al. . | |
| 5,666,935 | 9/1997 | Kato . | |
| 5,671,779 | 9/1997 | Koishikawa et al. | 440/89 |
| 5,673,676 | 10/1997 | Mukumoto . | |

*Primary Examiner*—Erick R. Solis
*Attorney, Agent, or Firm*—Knobbe, Martens, Olson & Bear, LLP

[57] ABSTRACT

A control system for an outboard motor is disclosed. The control system includes a feedback control which obtains feedback data from a combustion condition sensor. The motor includes an engine positioned in a cowling and having a vertically extending output shaft in driving relation with a water propulsion device of the motor. The engine has at least one combustion chamber and an air/fuel charging system for delivering air and fuel into the combustion chamber for combustion therein. The motor includes an exhaust system for routing exhaust from the engine to a point external to the motor. The exhaust system includes an exhaust passage leading from the chamber to a main exhaust passage which extends vertically downward to an exhaust guide positioned below the engine. A passage leads from the exhaust guide into an expansion chamber and thereon to an exhaust discharge. The feedback control is arranged to adjust the ratio of air and fuel supplied to the combustion chamber and includes a combustion condition sensor mounted to sense exhaust gas flowing through that portion of the exhaust system positioned above the exhaust guide.

18 Claims, 11 Drawing Sheets

CONTROL SYSTEM FOR AN OUTBOARD MOTOR

FIELD OF THE INVENTION

The present invention relates to a control system for an outboard motor. In particular, the present invention is a control system including a feedback control receiving information from one or more exhaust gas sensors.

BACKGROUND OF THE INVENTION

Various control methodology and systems have been employed in conjunction with internal combustion engines so as to improve their performance, particularly in the areas of fuel economy and exhaust emission control. One of the more effective types of controls is a "feedback" control. With this type of control, a basic air/fuel ratio is set for the engine for given engine running parameters. An adjustment to this basic ratio is made, if necessary, based upon data from a sensor with senses the air/fuel ratio in the combustion chamber.

Normally, the type of sensor employed for this feedback control is an oxygen ($O_2$) sensor. By determining the amount of oxygen in the exhaust gases from the combustion chamber, it is possible to fairly accurately measure the actual fuel ratio that was delivered to the combustion chamber. Most commonly, the sensor is arranged to sample the exhaust gasses after combustion, such as they pass through an exhaust passage leading from a combustion chamber.

The system operates on a feedback-control principle, continuously making corrections to accommodate deviations from the desired ratio. Adjustments are made in stepped intervals until the sensor output goes to the opposite sense from its previous signal. For example, if the mixture was running too rich, then adjustments are made in the lean direction until the mixture strength is sensed to be lean. Adjustments are then made in the opposite or rich direction in order to try to maintain the desired ratio.

For these systems to work properly, the data received from the sensor must be accurate. This requires that the sensor, in turn, sense a gas sample which is indicative of the true conditions with the combustion chamber. Achieving this goal in the outboard motor setting is difficult. Because of the size of the outboard motor, the exhaust system associated therewith is quite short. To provide reduce the temperature of the exhaust system and to achieve noise reduction, portions of the exhaust system are typically cooled. This cooling changes the characteristics of the exhaust therein.

In addition, the sensor must be mounted in a portion of the exhaust system which is accessible, and in the case of the outboard motor, still permits the exhaust system to fit within the small cowling of the motor and which is not in a location which exposes the sensor to water.

In accordance with the present invention there is a control system for an outboard motor, the control system including a sensor adapted to provide accurate sampling of exhaust gases to provide accurate feedback data.

SUMMARY OF THE INVENTION

In accordance with the present invention, there is provided a control system for an outboard motor. Preferably, the control system includes a feedback control which receives feedback control data from a combustion condition sensor.

The outboard motor has a powerhead and a lower unit depending therebelow. An engine is positioned in a cowling of the powerhead. The engine has an output shaft which extends generally vertically downward into the lower unit in driving arrangement with a water propulsion device of the motor.

The engine preferably operates on a four-cycle principle and has at least one combustion chamber and an air/fuel charging system for delivering air and fuel into the combustion chamber for combustion therein. The motor includes an exhaust system for routing exhaust from the engine to a point external to the motor. This exhaust system includes an exhaust passage leading from the combustion chamber of the engine. This exhaust passage leads to a main exhaust passage extending to an exhaust guide positioned below the engine. The exhaust is routed through the exhaust guide into an expansion chamber positioned in the lower unit of the motor. A discharge passage leads from the expansion chamber for routing exhaust to a point external to the motor.

The motor includes a control system having a feedback control which adjusts the ratio of air and fuel supplied to the combustion chamber of the engine. This feedback control obtains feedback control data from at least one combustion condition sensor mounted to sense exhaust gas flowing through that portion of the exhaust system above the exhaust guide.

In one preferred embodiment of the invention, the engine has combustion chambers which are vertically arranged, and the combustion condition sensor is mounted to sense the exhaust gas flowing through an exhaust passage leading from a top or a bottom of the combustion chambers.

In another preferred embodiment of the invention, a combustion condition sensor is mounted to sense exhaust gas flowing through a top or bottom portion of the main exhaust passage.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor 20 having a control system. The control system preferably includes a feedback control which obtains feedback control data from an oxygen sensor mounted in an exhaust passage.

Figure 1:
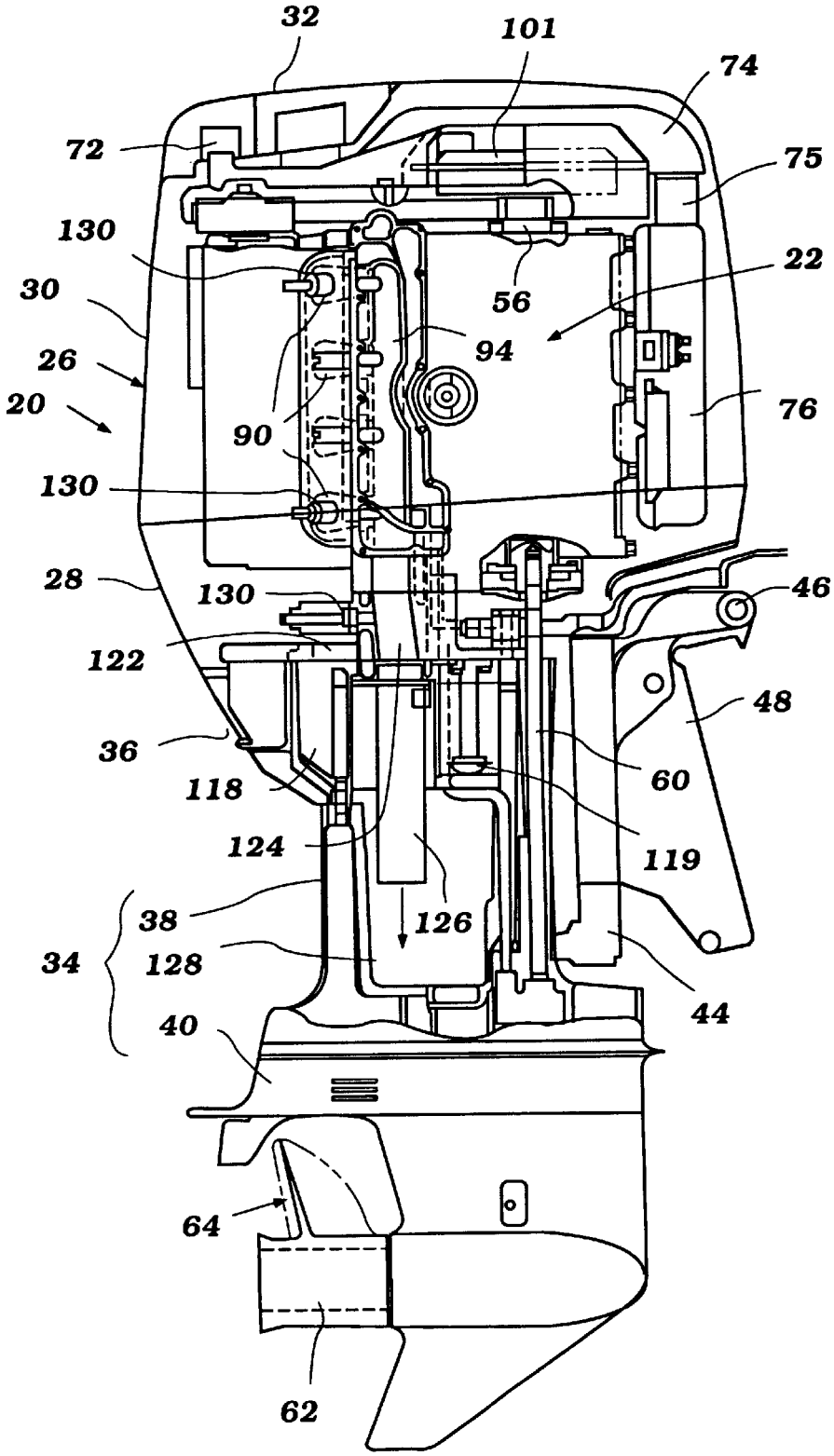
FIG. 1 is a side view of an outboard motor for use in propelling a watercraft, the motor having a control in accordance with the present invention and powered by an engine of the first type mounted in a cowling thereof the engine illustrated with portions thereof cut-away.

As best illustrated in FIG. 1, the outboard motor 20 is utilized to power a watercraft 24. The outboard motor 20 has a powerhead area 26 comprised of a lower tray portion 28 and a main cowling portion 30. An air inlet or vent 32 is provided in the main cowling portion 30 for providing air to an engine therein, as described in more detail below. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the lower section 40 of the lower unit 34 by means of a bracket. The steering shaft is supported for steering movement about a vertically extending axis within a swivel bracket 44. The swivel bracket 44 is connected by means of a pivot pin 46 to a clamping bracket 48 which is attached to a transom portion of a hull of a watercraft (not shown). The pivot pin 46 permits the outboard motor 20 to be trimmed and tilted up about the horizontally disposed axis formed by the pivot pin 46.

Figure 2:
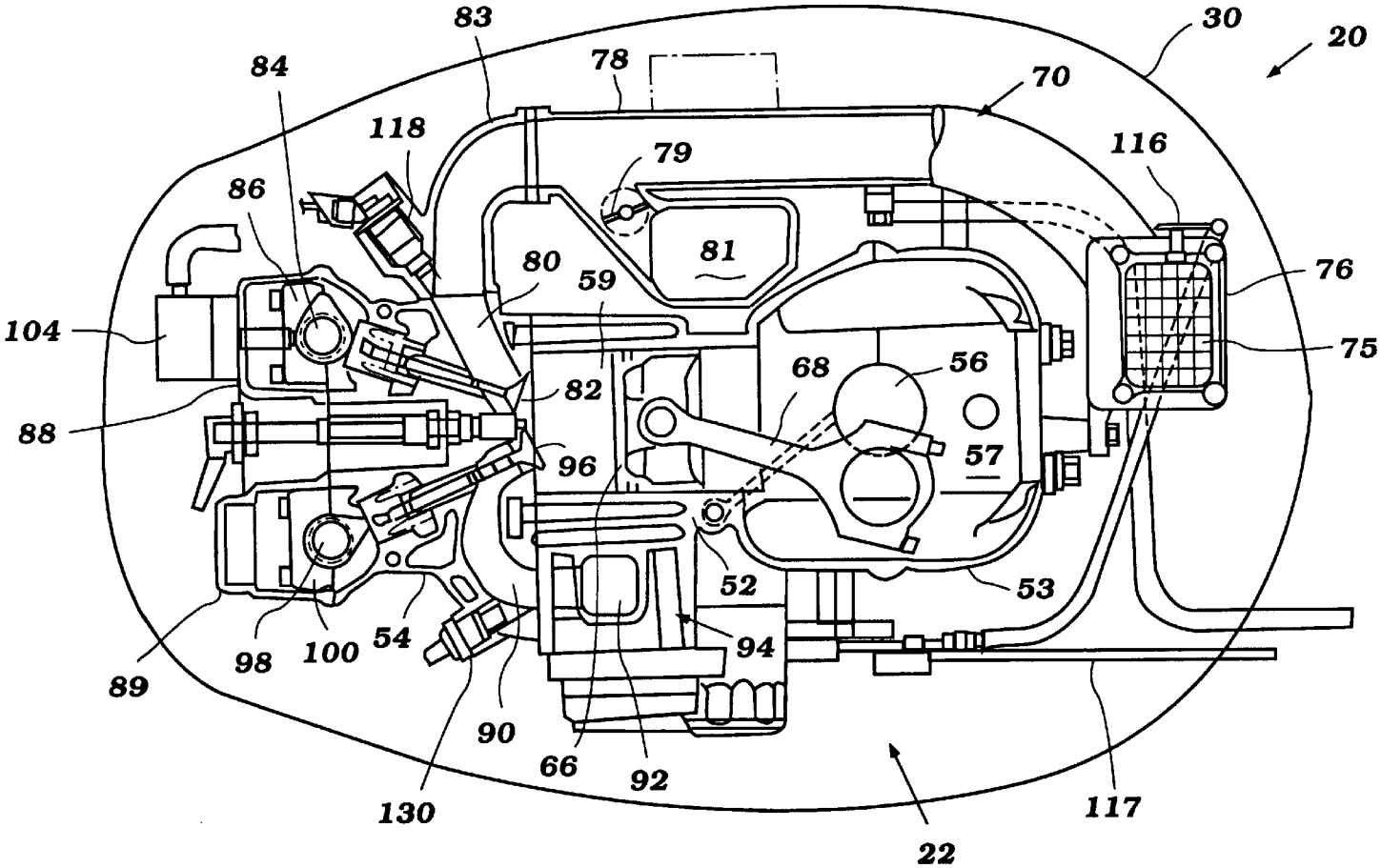
FIG. 2 is a top view, in cross-section, illustrating the internal combustion engine illustrated in FIG. 1.
Figure 3:
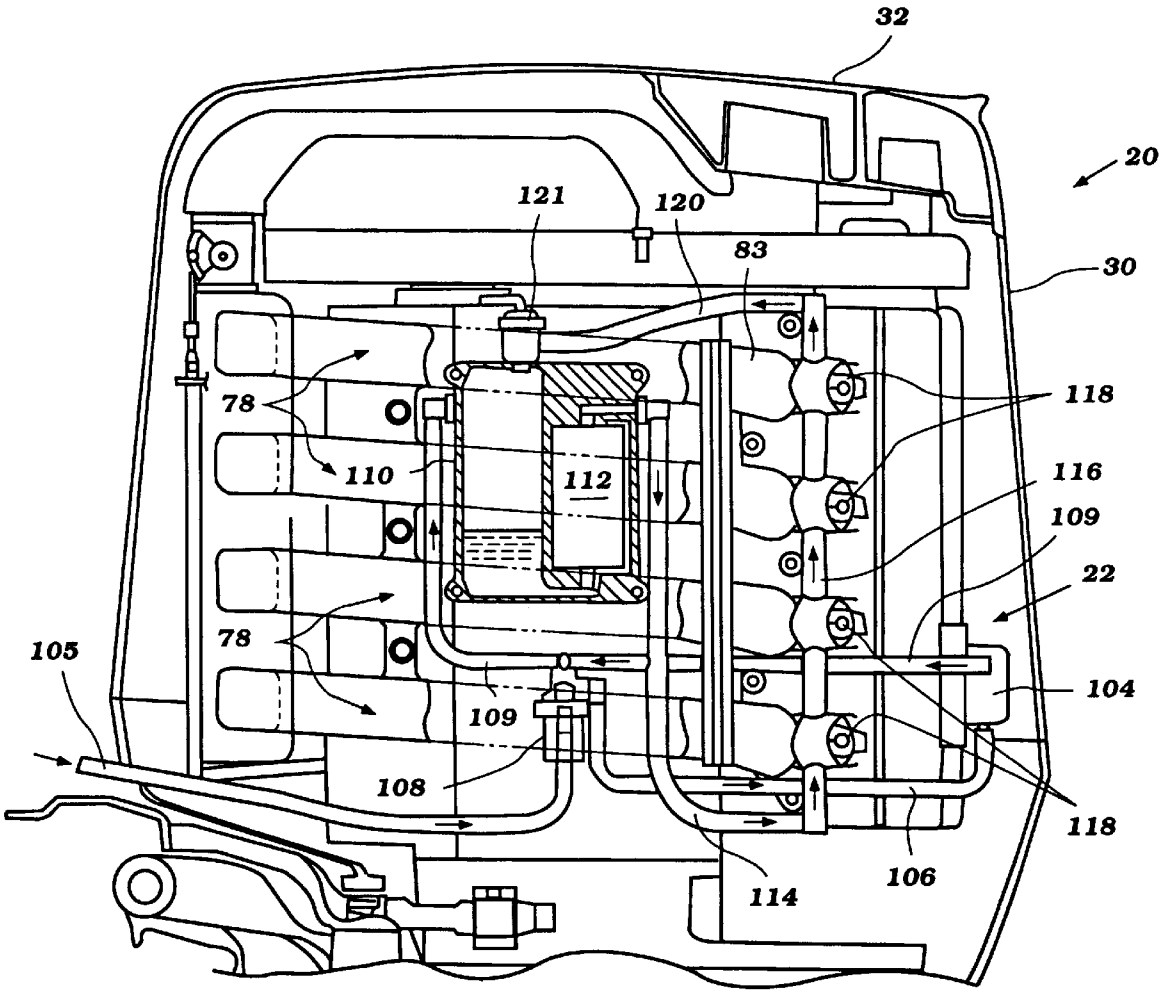
FIG. 3 is a side view of the motor and engine illustrated in FIG. 1, in partial cross-section.

As best illustrated in FIGS. 2 and 3, the power head 26 of the outboard motor 20 includes the engine 22 which is positioned within the cowling portion 30. In the embodiment of the present invention illustrated in FIGS. 1–3, the engine 22 is preferably of the inline, four-cylinder, four-cycle variety, and thus includes a cylinder block 52 which has a cylinder bank closed by a cylinder head assembly 54 in a manner which will be described. As also illustrated in FIGS. 2 and 3, the engine 22 is preferably oriented within the cowling 30 such that its cylinder head 54 is positioned on the block 52 on the side opposite the watercraft's transom.

A crankshaft 56 is rotatably journalled in a crankcase chamber formed by the cylinder block 52 a crankcase cover 50. As is typical with outboard motor practice, the engine 22 is mounted in the power head 26 so that the crankshaft 56 rotates about a vertically extending axis. This facilitates coupling to a drive shaft 60 in a manner which will be described.

The drive shaft 60 depends into the lower unit 34, wherein it drives a bevel gear and a conventional forward-neutral-reverse transmission. The transmission is not illustrated herein, because its construction per se forms no part of the invention. Therefore, any known type of transmission may be employed.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art.

The construction of the engine 22 will now be described in more detail. As illustrated in FIGS. 1–3, the engine 22 has a number of variable volume combustion chambers 59, preferably totaling four in number, arranged in inline fashion. It should be understood that there may be as few as one combustion chamber, or more than four.

Each combustion chamber has a piston 66 mounted therein for reciprocation, the piston connected to the crankshaft 56 via a connecting rod 68. The crankshaft 56 rotates within a crankcase chamber 57 defined by the cylinder block 52 and a cover or pan 53 connected thereto. The cylinder head 54 is preferably connected to the cylinder block 52 via a number of bolts, as is known in the art.

As illustrated, an intake system 70 provides air to each combustion chamber. The intake system 70 includes an air intake 72 positioned adjacent the vent 32 in the cowling 30. As best illustrated in FIG. 2, air drawn through this intake 72 passes into an air passage formed between the cowling 30 and a camshaft drive cover 74 positioned on the top of the engine 22 and then through an intake pipe 75 into a surge tank 76. Air is routed from the surge tank 76 by a runner 78 to a passage through an intake manifold 83, and then through a passage 80 positioned within the cylinder head 54 leading to the combustion chamber. An inlet passage 80 is provided corresponding to each combustion chamber 59. As illustrated, an equalization chamber 81 is preferably provided along the runner 78 for storing air at high pressure and then releasing it into the intake system when the pressure therein is low, whereby a relatively steady flow of air is provided to each combustion chamber. A valve 79 controls the flow of air into and out of the chamber 81.

A throttle 116 is provided for controlling the flow of air through the main intake pipe 75 to the combustion chambers 59. Preferably, the throttle 116 comprises a moveable plate positioned in a throttle body portion of the intake pipe 75. The throttle 116 is preferably controlled through a cable 117 by the operator of the watercraft 24.

Means are provided for controlling the passage of air through each inlet passage 80 to the combustion chambers 59. Preferably, this means comprises an intake valve 82. As illustrated, each intake valve 82 is preferably actuated by an intake camshaft 84. The intake camshaft 84 is mounted for rotation with respect to the head 54 and connected thereto with at least one bracket 86. The camshaft 84 is enclosed by a camshaft cover 88 which is connected to the head 54.

An exhaust system is provided for routing the products of combustion within the combustion chambers 59 to a point external to the engine 22. In particular, an exhaust passage 90 leads from each combustion chamber to a passage 92 in an exhaust manifold portion 94 of the engine 22. The remainder of the exhaust system will be described in more detail below.

Means are also provided for controlling the flow of exhaust from each combustion chamber 59 to its respective exhaust passage 92. Preferably, this means comprises an exhaust valve 96. Like the intake valves 82, the exhaust valves 96 are preferably all actuated by an exhaust camshaft 98. The exhaust camshaft 98 is journalled for rotation with respect to the cylinder head 54 and connected thereto with at least one bracket 100. The exhaust camshaft 98 is enclosed within a camshaft cover 89 as well.

Means are provided for driving the camshafts 84,98. This means comprises a drive as well known in the art, such as a pulley mounted on the crankshaft 56 and a pulley mounted on each camshaft 84,86, and drive belt routed around the pulleys (see FIG. 1). One or more tensioner pulleys may be provided for maintaining the belt in a taunt condition.

Preferably, a flywheel 101 is connected to a top end of the crankshaft 56, and positioned under the cover 74, as illustrated in FIG. 1. The flywheel 101 may include a pulser coil for use in an ignition system, as is well known to those skilled in the art.

A fuel delivery system is provided for delivering fuel to each combustion chamber 59 for combustion therein. The fuel delivery system preferably includes a fuel tank (not shown) which is normally positioned within the watercraft. Fuel is drawn from the fuel tank by a fuel pump 104 through a supply line 105. The supply line 105 extends to a fuel filter 108 which is preferably mounted to a side of the engine 22.

Fuel passing through the filter 108 passes through a fuel line 106 to the pump 104. As illustrated in FIG. 3, the fuel pump 104 is positioned on the camshaft cover 88 at the end of the engine 22 opposite the watercraft.

Fuel is supplied by the pump 104 to a chamber of a vapor separator 110 through a delivery line 109. Fuel is drawn from the chamber of the separator by a high pressure pump 112. Fuel under high pressure is delivered by the pump 112 through a high pressure fuel line 114 to a fuel rail 116. As illustrated and described in more detail below, the fuel rail 116 extends along a side of the engine 22. Fuel is delivered by the rail 116 to a fuel injector 118 corresponding to each combustion chamber 59. Any fuel which is supplied to the rail 116 but which is not delivered by the injectors 118 is routed through a return line 120 through a pressure regulator 121 back into the chamber of the vapor separator 110 for pumping fuel from the tank and delivering it to each combustion chamber 59.

A suitable ignition system is provided for igniting an air and fuel mixture within each combustion chamber 59. Such systems are well known to those skilled in the art, and as such forms no portion of the invention herein, such is not described in detail here.

The engine 22 includes a lubricating system for providing lubricant to the various portions of the engine. The lubricating system is not described in detail here, and may be of a variety of types found suitable to those skilled in the art. Generally, the lubricating system includes an oil reservoir 118 positioned below the engine 22. An oil pump (not shown) which is preferably driven by the crankshaft 56 of the engine draws lubricant from the reservoir 118 via a suction tube 119 and delivers it through oil passages throughout the engine 22. The pumped oil drains from the engine 22 back to the reservoir 118 for recirculation by the pump.

As illustrated in detail in FIG. 2, the exhaust manifold 94 is preferably formed integrally with the cylinder block 52. In this arrangement, the exhaust passage 92 is simply a passage extending generally vertically through an extended portion of the cylinder block 52.

Figure 4:
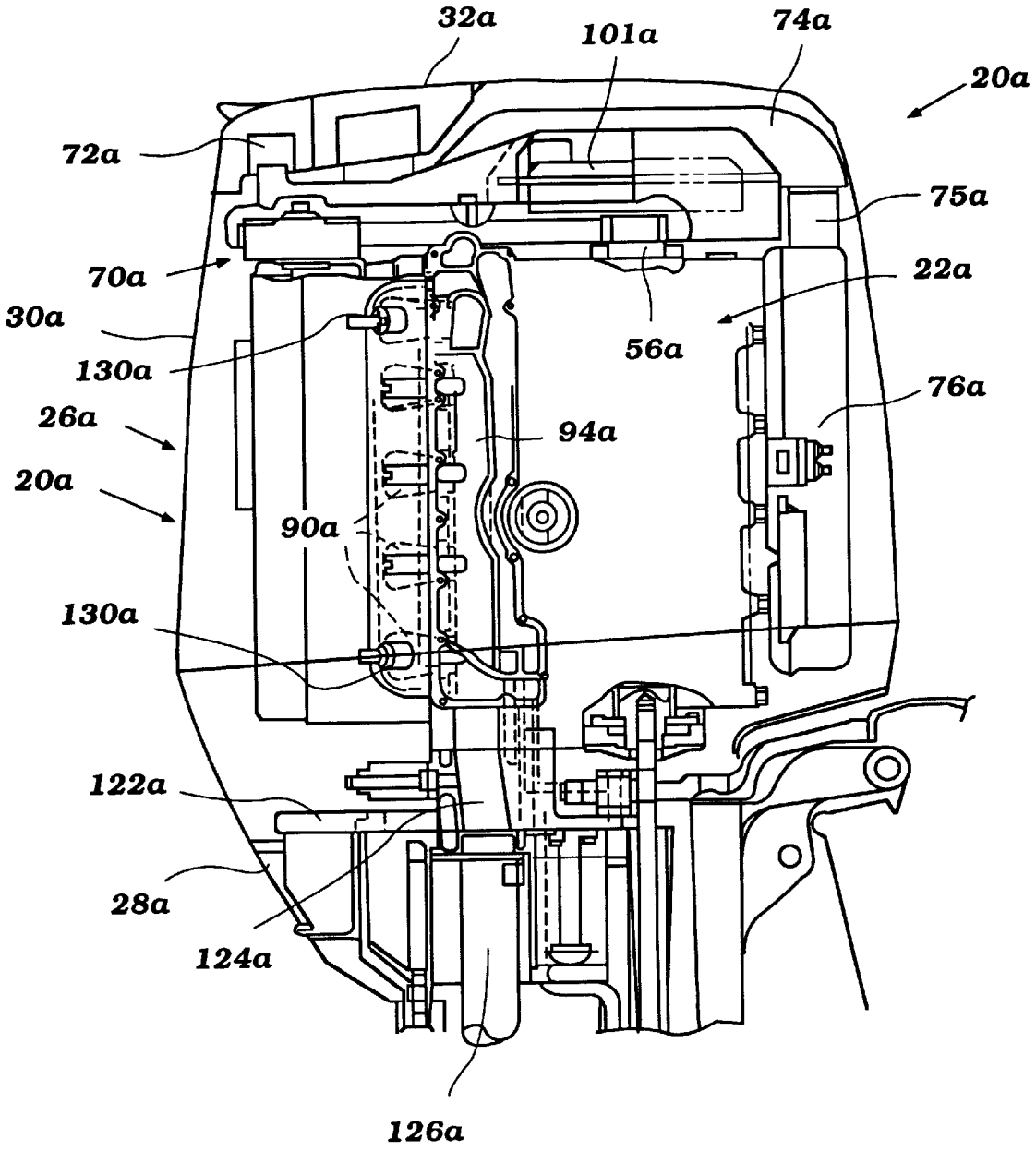
FIG. 4 is a partial side view of an outboard motor powered by an engine of a second type positioned within a cowling thereof the motor having a control in accordance with the present invention, the engine illustrated with portions thereof cut-away.

As best illustrated in FIG. 4, an exhaust guide 122 is positioned at the bottom end of the engine 22. The exhaust guide 122 has a passage 124 extending therethrough which is aligned with the passage 92 at its top side. An exhaust pipe 126 is connected to the bottom side of the exhaust guide 122 in alignment with the passage 124. The exhaust pipe 126 terminates within a chamber formed within a muffler or expansion chamber 128.

The muffler 128 is positioned within the lower unit and may be cooled externally with coolant flowing through a water jacket surrounding at least a portion of the muffler. An exhaust gas outlet (not shown) is provided in the bottom end of the muffler 128, through which the exhaust gas is routed to a point external of the motor 20, normally through a passage extending through the hub 62 of the propeller 64. The exhaust system may include an above-the-water exhaust gas discharge for times when the exhaust gas pressure is low.

The engine 22 may include a cooling system for routing coolant, such as water from the body of water in which the motor 20 is operating, through one or more coolant passages or jackets of the engine for cooling the engine. Such cooling systems are well known to those skilled in the art.

In accordance with the present invention, the motor 20 preferably includes a control system. Preferably, the control system includes feedback means for adjusting the air/fuel ratio of the charge supplied to each combustion chamber 59 and means for supplying feedback control data to the feedback means. Preferably, the means for supplying feedback control data comprises a combustion condition sensor in the form of an oxygen ($O_2$) sensor 130. The sensor 130 may be of the type including a platinum-plated glass tube having a hollow center, an electrical heater extending into the hollow center, the heater communication with a control unit through a shielded conductor. The sensor 130 may be arranged in other manners, however, as known to those skilled in the art.

The sensor 130 is arranged to be in communication with exhaust gas generated by the engine 22. In this manner, the sensor 130 provides an output signal indicative of the oxygen content of the exhaust gas, and thus provides an indicator of the fuel/air ratio of the charge supplied to the engine.

As illustrated, at least one sensor 130 is mounted so that its sensing portion is positioned within the exhaust passage 90 leading from one of the cylinders 59. In the preferred embodiment, a sensor 130 is mounted to sense exhaust flowing through the exhaust passage 90 corresponding to a top or bottom cylinder, as illustrated in FIG. 1. Alternatively, a sensor 190 may preferably be mounted so that its sensing portion is arranged to sample exhaust gas passing through the main or common exhaust passage 92 through the exhaust manifold 94 above the exhaust guide 122.

As illustrated, the sensor 190 is preferably arranged so that its sensing portion is generally aligned with a direct flow path of exhaust flowing through the respective passage in which it is position. Thus, the sensor 190 mounted in the exhaust passages 90 leading from each cylinder 59 is positioned at a bend of the passage 90 before the common exhaust passage 92. In this manner, the exhaust flows from the cylinder 59 directly towards the sensor 190, and then impacts the sensor 190 and adjacent wall for redirection into the common passage 92.

Output from the sensor 190 is preferably provided to a control unit (not shown) for use in adjusting the rate of fuel and/or air delivery to the engine 22 based on a desired air/fuel ratio for the engine 22 at a particular operating condition, in accordance with one or more control strategies which are well known in the art.

The sensor positions described above have the advantage that the exhaust which is sensed thereby provides an accurate indication of the actual combustion conditions within the engine. In particular, in these positions, the exhaust which the sensor senses is not cooled substantially nor in a state of continued combustion. In addition, these sensor positions are such that the sensor is accessible, and yet does not increase size of the engine.

Figure 5:
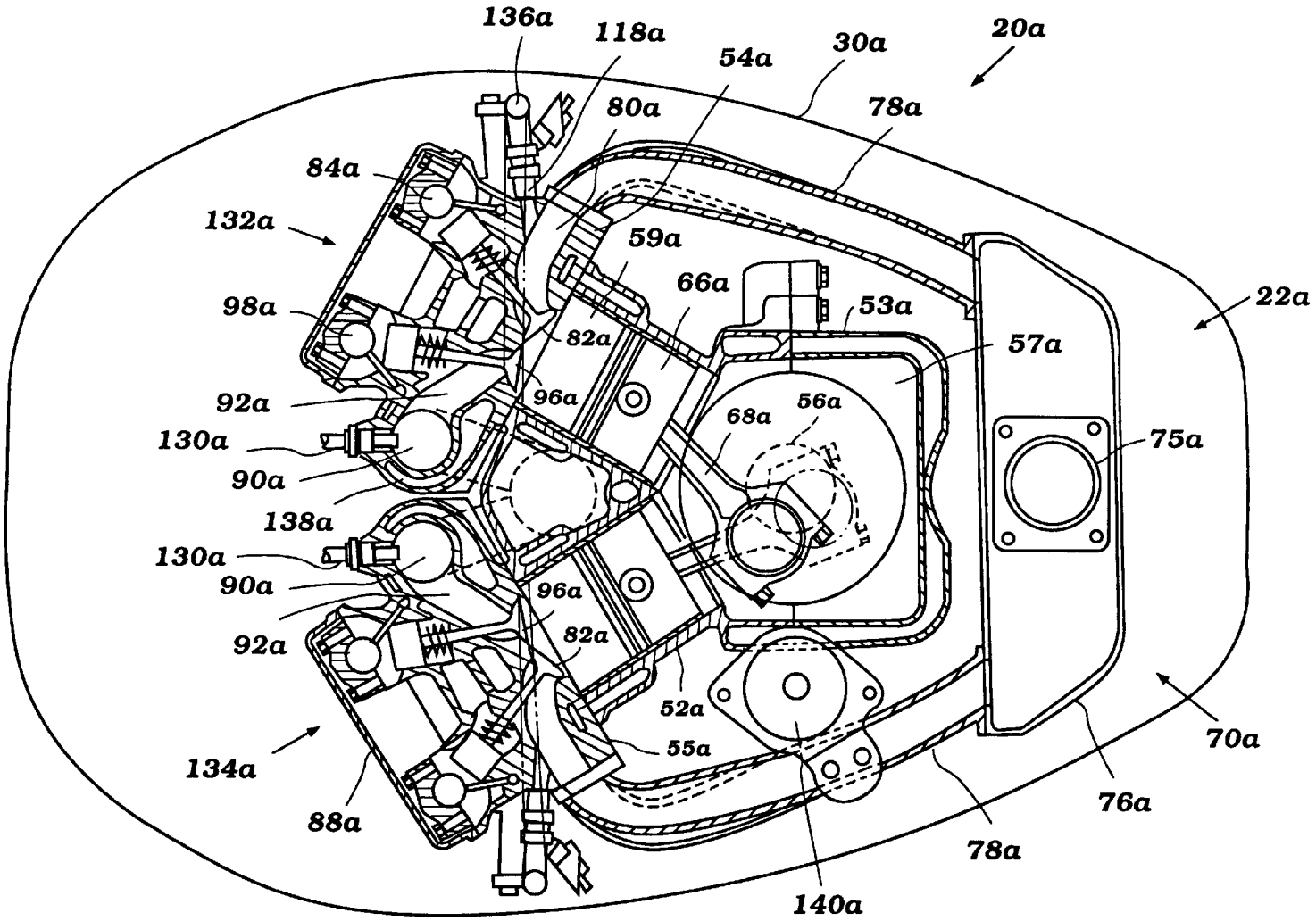
FIG. 5 is a top view, in cross-section, illustrating the internal combustion engine illustrated in FIG. 3.
Figure 6:
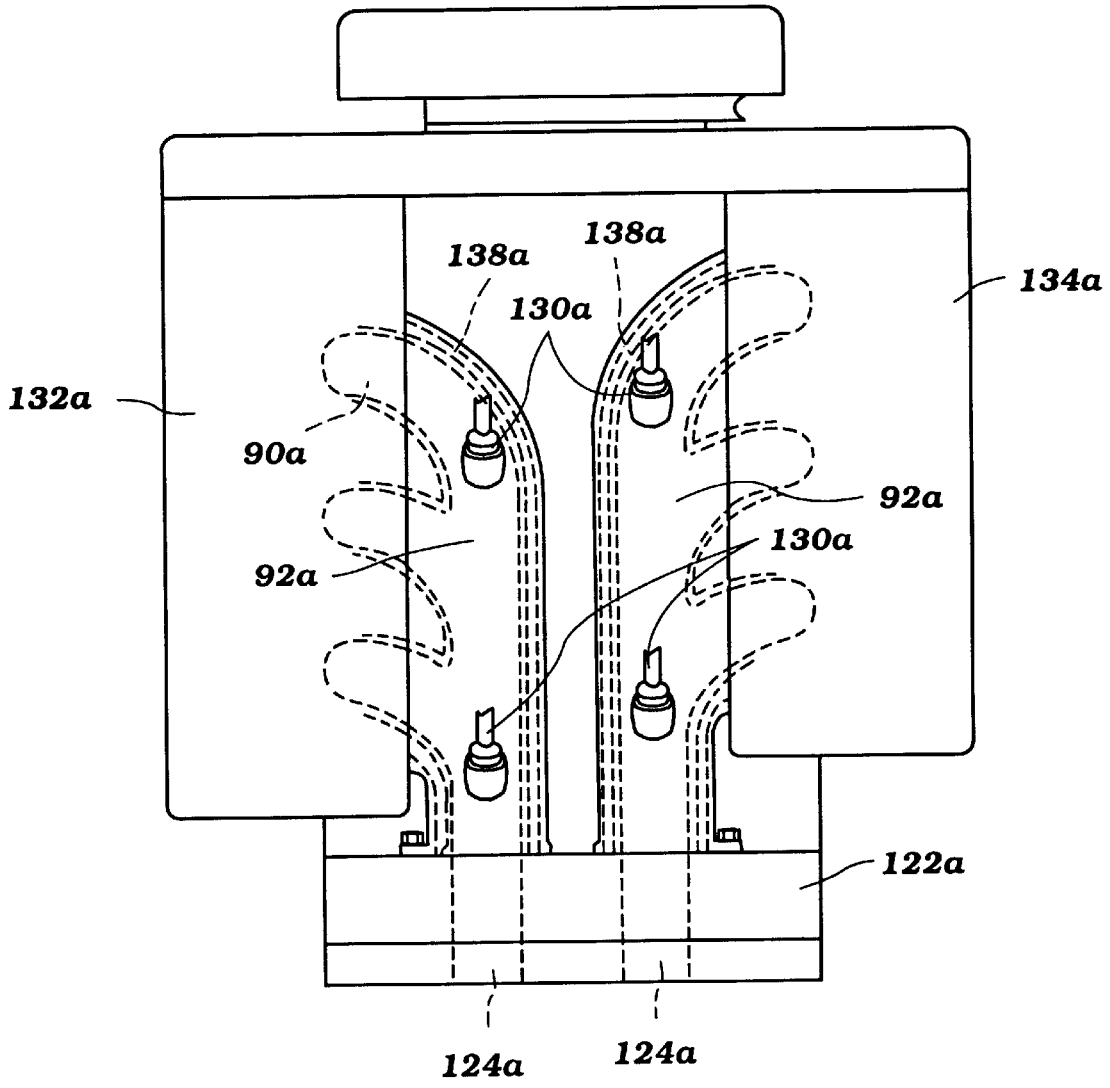
FIG. 6 is a front end view of the engine illustrated in FIG. 4 and illustrating an exhaust sensor mounting arrangement of the control of the present invention when the engine has six cylinders.

FIGS. 4–6 illustrate a motor having a control system in accordance with a second embodiment of the present invention. This embodiment of the invention is similar to the first, and as such, similar parts have been given similar reference numerals to those used in the description and illustration of the first embodiment, except that an "a" designator is added thereto.

As illustrated therein, this embodiment is arranged to be used with an engine 22*a* of the "V"-type having first and second banks 132*a*,134*a* each containing at least one cylinder. In the embodiment illustrated, the engine 22*a* has six-cylinders, three cylinders per bank.

Preferably, the engine 22*a* is used to power a propeller (not shown) of an outboard motor 20*a* in a similar fashion to that described above. The particulars of the outboard motor 20*a* construction are not repeated here. The engine 22*a* is preferably mounted in a cowling 30*a* of the motor 22*a*.

The engine 22*a* is best illustrated in FIG. 5. The engine 22*a* has a cylinder block 52*a* with a first cylinder head 54*a* and a second cylinder head 55*a* connected thereto. As stated above, each bank 132*a*,134*a* preferably defines three combustion chambers or cylinders 59*a*.

A piston 66*a* is movably positioned in each cylinder 59*a*. Each piston 66*a* is connected to a connecting rod 68*a* extending to a vertically extending crankshaft 56*a*. The crankshaft 56*a* is arranged to drive a propeller in a manner similar to that described above.

The crankshaft 56*a* is journalled for rotation with respect to the cylinder block 52*a*. A crankcase cover 53*a* engages an end of the block 52*a*, defining therewith a crankcase chamber 57*a* within which the crankshaft rotates.

As with the engine 22*a* described above, the engine 22*a* includes an air intake system 70*a* for providing air to each combustion chamber 59*a*. As illustrated in FIG. 4, air passes through the vent 32*a* in the motor cowling 30*a* and through an air intake 72*a* and through a passage defined in part by a flywheel cover 74*a* to a main intake pipe 75*a* positioned at the opposite end of the engine 22*a*. This pipe 75*a* leads into a surge tank 76*a*. A branch intake passage 78*a* leads from the surface tank 76*a* to an intake passage 80*a* leading through the cylinder head 54*a*,55*a* to each combustion chamber 59*a*. As illustrated, the intake passages 78*a* extend generally around the outside of the engine to the outer side of each cylinder head 54*a*,55*a* opposite a valley formed between the banks 132*a*,134*a*.

Means are provided for controlling the flow of air into each combustion chamber 59*a*. Preferably, this means comprises an intake valve 82*a* corresponding to each intake passage 80*a*. As illustrated, all of the intake valves 82*a* for each bank of cylinders are preferably actuated by a single intake camshaft 84*a*. The intake camshaft 84*a* is mounted for rotation with respect to the head 54*a*,55*a* and connected thereto with at least one bracket. The camshaft 84*a* of each bank 54*a*,55*a* is enclosed by a camshaft cover 88*a* which is connected to the respective head 54*a*,55*a*.

An exhaust system is provided for routing the products of combustion within the combustion chambers 59*a* to a point external to the engine 22*a*. In particular, an exhaust passage 90*a* leads from each combustion chamber to a main or common passage 92*a* in an exhaust manifold portion of the engine 22*a*. The remainder of the exhaust system will be described in more detail below.

Means are also provided for controlling the flow of exhaust from each combustion chamber 59*a* to its respective exhaust passage 90*a*. Preferably, this means comprises an exhaust valve 96*a*. Like the intake valves 82*a*, the exhaust valves 96*a* of each cylinder bank are preferably all actuated by a single exhaust camshaft 98*a*. Each exhaust camshaft 298 is journalled for rotation with respect to its respective cylinder head 254*a*,*b* and connected thereto with at least one bracket. Each exhaust camshaft 298 is enclosed within the camshaft cover 288.

Means are provided for driving the camshafts 84*a*,98*a*. Preferably, this means comprises a belt drive system positioned at the top end of the engine for driving each camshaft off of the crankshaft 56*a*, as is well known in the art.

A fuel delivery system is provided for delivering fuel to each combustion chamber 59*a* for combustion therein. The fuel delivery system preferably includes a fuel tank (not shown) and a fuel pump (not shown) for pumping fuel from the tank and delivering it to each combustion chamber 59*a*. Preferably, the pumped fuel is directed through a fuel rail 136*a* to a fuel injector 118*a* which injects fuel into the air stream flowing through each air intake branch 78*a*.

A throttle (not shown) may be provided for controlling the flow of air into the combustion chambers 59*a*. In addition, a suitable ignition system is provided for igniting an air and fuel mixture within each combustion chamber 59*a*. Such systems are well known to those skilled in the art, and as such forms no portion of the invention herein, such is not described in detail here.

The engine 22*a* preferably also includes a lubricating system for providing lubricant to the various portions of the engine. The lubricating system is not described in detail here, and may be of a variety of types found to those skilled in the art.

A cooling system is provided for cooling the engine 22*a* The cooling system is preferably arranged so that water from the body of water in which the motor 20*a* is operating is drawn and routed through various cooling passages. For example, cooling liquid is preferably routed through one or more cooling passages or jackets 138*a* for cooling portions of the exhaust system.

As illustrated in FIG. 5, an exhaust manifold is preferably formed integrally with each cylinder head 54*a*,55*a*. In this arrangement, a common exhaust passage 92*a* is provided corresponding to each bank and extends along the inside portion of each cylinder head 54*a*,55*a* in the valley portion of the engine 22*a*. Each exhaust passage 90*a* leads from its respective combustion chamber 59*a* to the common passage 92*b*.

As best illustrated in FIG. 4, an exhaust guide 122*a* is positioned at the bottom end of the engine 22*a*. The exhaust guide 122*a* has a pair of passages 124*a* extending therethrough which is aligned with the pair of common passages 92*a*. An exhaust pipe 126*a* is connected to the bottom side of the exhaust guide 122*a* in alignment with the passages 124*a*. The exhaust pipe 126*a* terminates within a chamber formed within a muffler (not shown). An exhaust gas outlet is provided in the bottom end of the muffler, through which the exhaust gas is routed to a point external of the motor 20*a*.

As illustrated in FIG. 5, the engine 22*a* may also include a starter 140*a* which selectively engages the flywheel for use in starting the engine. The engine may include other accessories as well known to those skilled in the art.

At least one sensor 130*a* is provided for use in a control system of the outboard motor, in like manner to that described above. As illustrated in FIG. 6, a sensor 130*a* is preferably mounted at a top portion of each common passage 92*a* near the entrance thereto of the exhaust passage 90*a* corresponding to the top cylinders 59*a*. In the alternative, a pair of sensors 130*a* may also be mounted in the common passages 92*a* near their bottom end above the exhaust guide 122*a* and near the entrance of the exhaust passages 90*a* leading from the bottom cylinders.

As illustrated in FIG. 5, the sensors 130*a* are preferably mounted so that they face generally in the direction of exhaust gas flow so that the exhaust gas flowing through the exhaust passage 90*a* into the common passage 92*a* impact generally directly upon the sensor.

These sensor 130*a* positions have the same general benefits and overcome the same problems as described above in conjunction with the first embodiment. In addition, it is noted that in this embodiment, like the last, the portion of the exhaust system in which the sensor 130*a* is position is generally opposite the intake system of the engine, thereby reducing the cooling effect on the exhaust before it is sensed.

Figure 7:
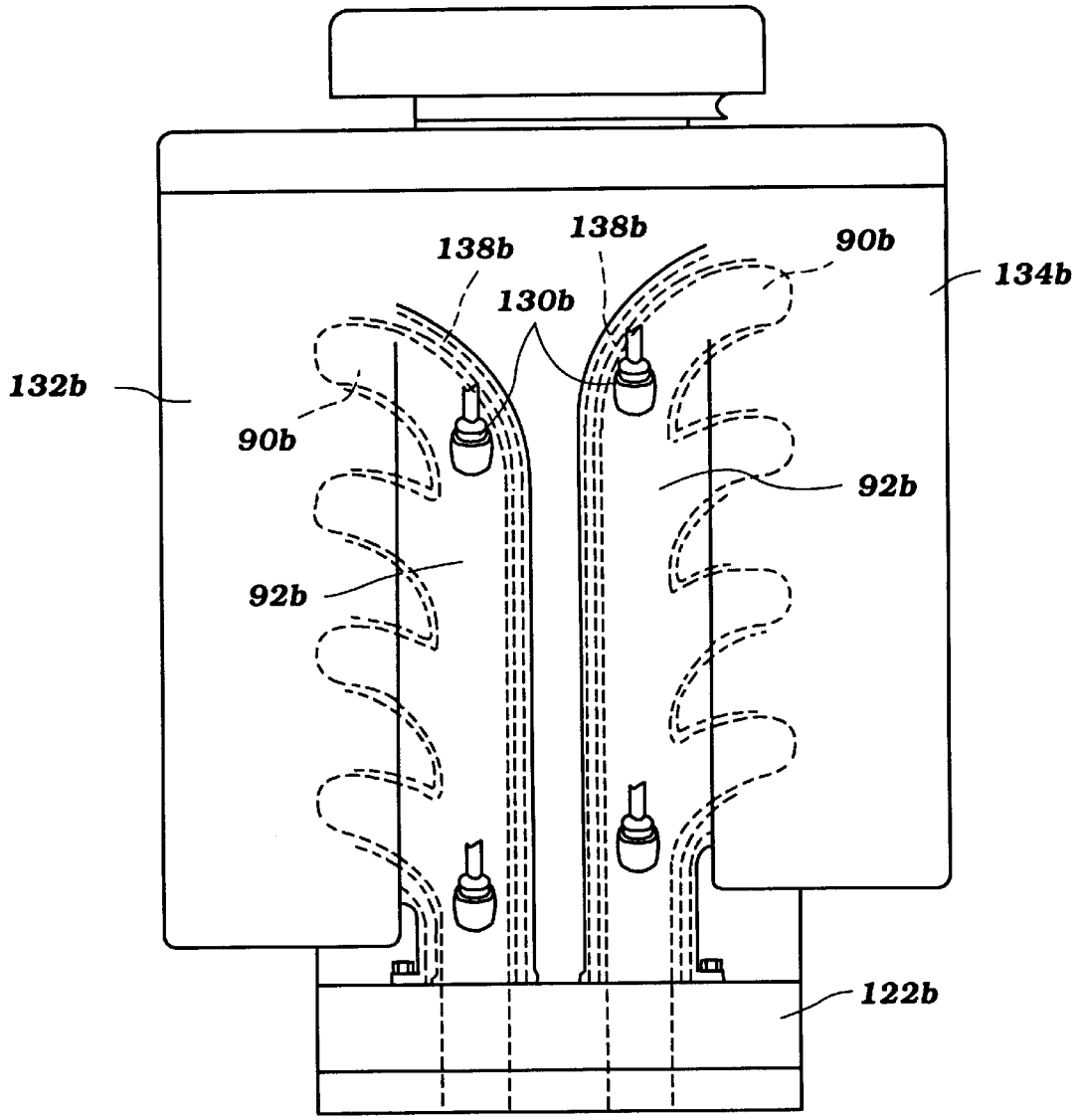
FIG. 7 is a front end view of the engine illustrated in FIG. 4 and illustrating an exhaust sensor mounting arrangement of the control of the present invention when the engine has eight cylinders.

FIG. 7 illustrates a variant of this embodiment of the invention in which the engine is of the "V"-type and includes a total of eight cylinders, four cylinders per bank 132*b*,134*b*. In the illustration of this embodiment, similar parts have been given like reference numerals to those used in the description and illustration of the last embodiment, except that "b" designator has been added thereto.

In this embodiment, the sensors 130*b* are similarly mounted to those of the embodiment illustrated in FIG. 6, with a sensor mounted at a top end of each of the common exhaust passages 92*b* or near a bottom end 90*b*. Preferably, each sensor 130*b* is mounted in the same orientation as that described so that exhaust gas impacts upon the sensor.

Figure 8:
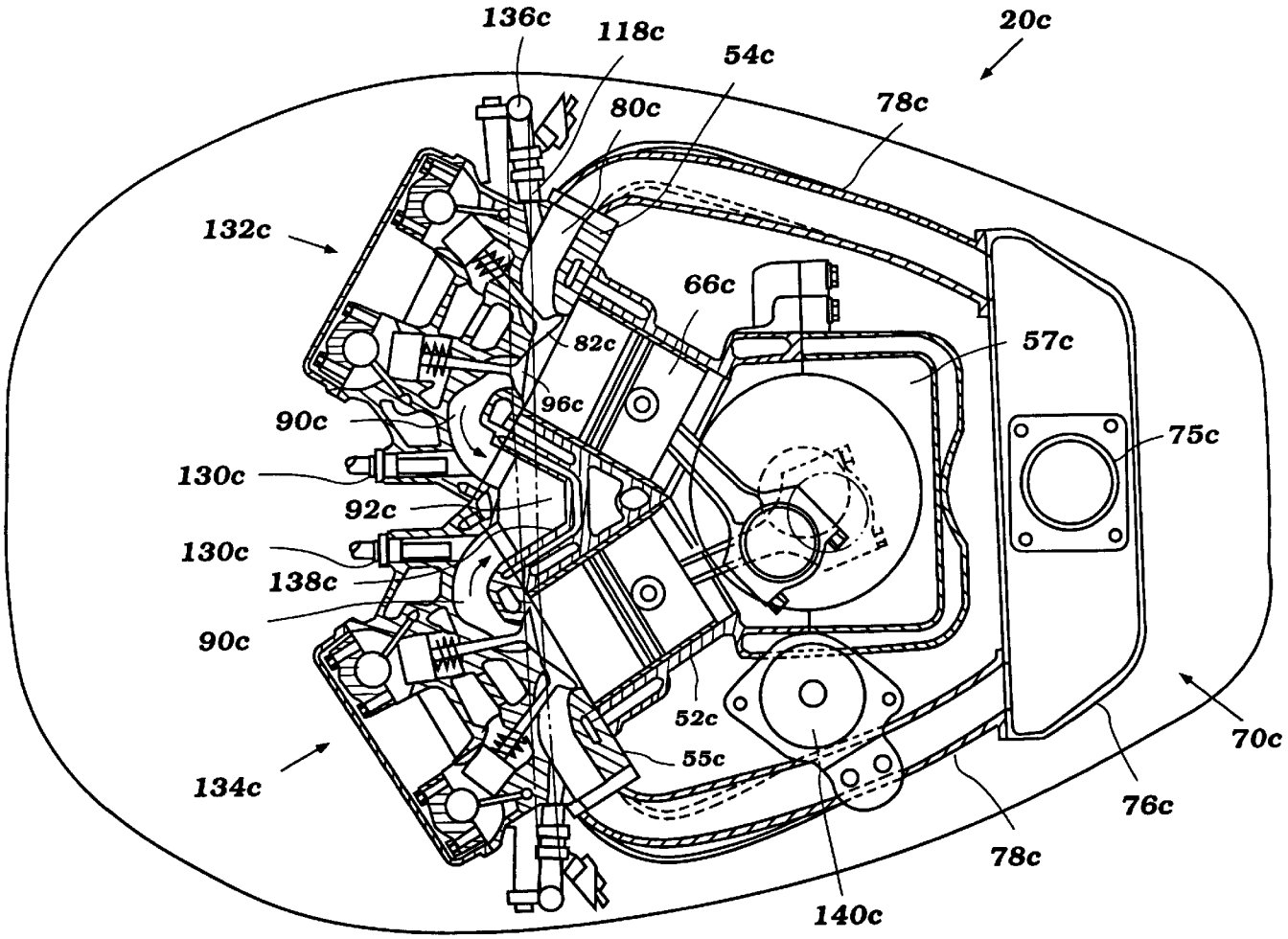
FIG. 8 is a top view, in cross-section, illustrating an engine positioned within a cowling of an outboard motor, the engine having a different exhaust system arrangement from the engine illustrated in FIG. 4, the motor having a control with an exhaust sensor mounting arrangement in accordance with of the present invention.
Figure 9:
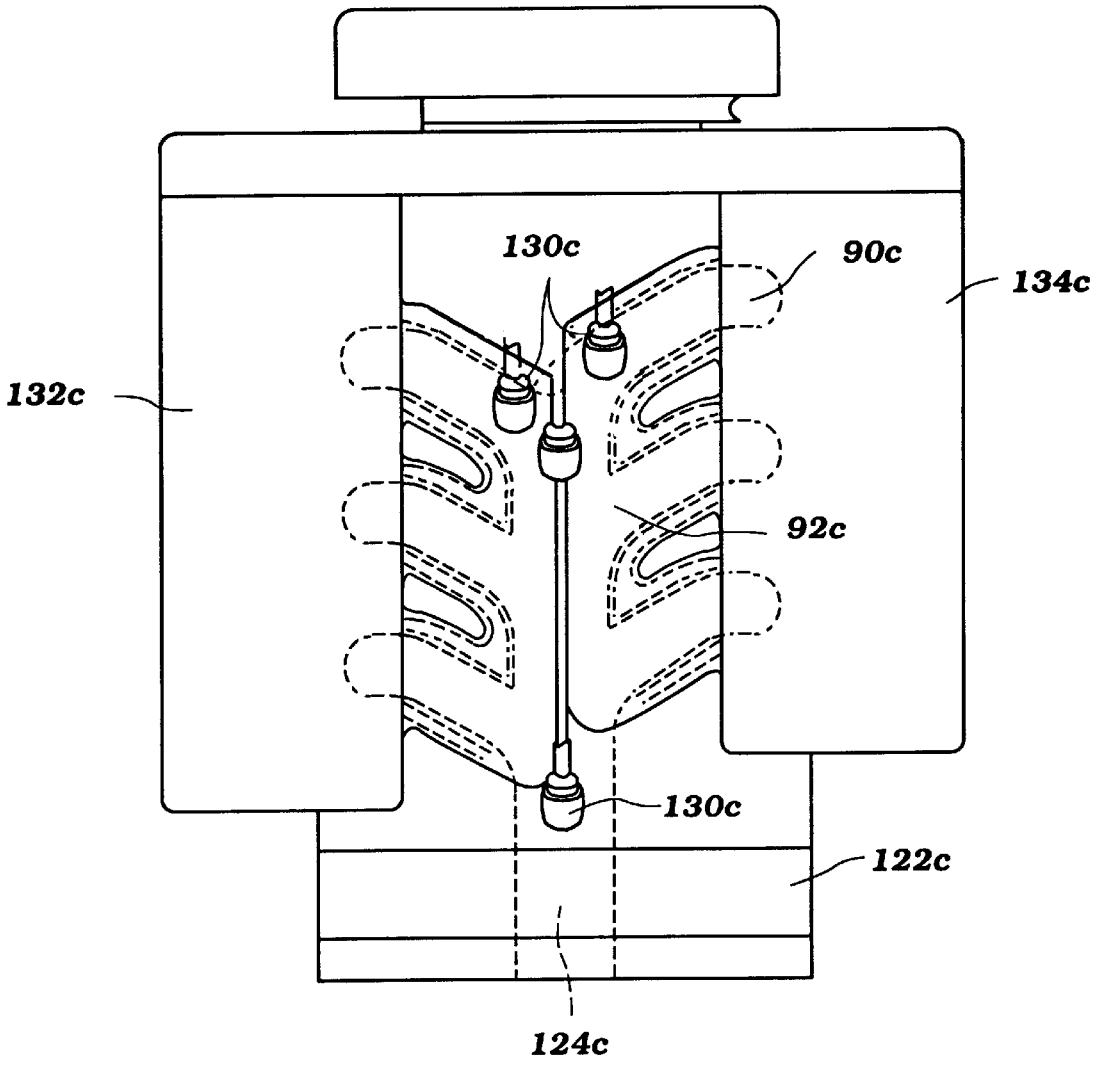
FIG. 9 is a front end view of the engine illustrated in FIG. 7 and illustrating an exhaust sensor mounting arrangement of the control of the present invention when the engine has six cylinders.

FIGS. 8 and 9 illustrate a fourth embodiment motor having a control system in accordance with the present invention. This embodiment is similar to that illustrated in FIGS. 4–6, and as such, similar parts have been given similar reference numerals to those used in the description and illustrations of that embodiment, except that a "c" designator has been added all reference numerals of this embodiment.

In this embodiment the exhaust passage 90*c* leading from each cylinder or combustion chamber 59*c* extends through a respective cylinder head 54*c*,55*c* to a single common exhaust passage 92*c*. The common exhaust passage 92*c* extends through the valley of the engine between its banks 132*c*,134*c* and generally defined by the cylinder block 53*c*. As illustrated in FIG. 9, the common exhaust passage 92*c* preferably extends to a single passage 124*c* through the exhaust guide 122*c* and therebeyond to a muffler (not shown, but described in more detail above).

The control system of this embodiment of the invention includes at least one sensor 130*c* arranged to sense the exhaust gas flowing through the common exhaust passage 92*c*. Preferably, this sensor 130*c* is of a type similar to that described above, sensing the oxygen content of the exhaust gas and arranged to supply this data to a feedback control of the control system for use in making air/fuel feedback control adjustments.

Preferably, a sensor 130*c* is mounted in at least that passage 90*c* extending from the top cylinder 59*c* of one of the two banks 132*c*,134*c*. Alternatively, a sensor 130*c* may be mounted centrally within the common passage 92*c* near its top end and at the connection of each top exhaust passage 90*c*, or at the bottom end of the common passage 92*c* near the connection of the lower exhaust passages 90*c* and near where it connects to the passage 124*c* extending through the exhaust guide 122*c*.

Figure 10:
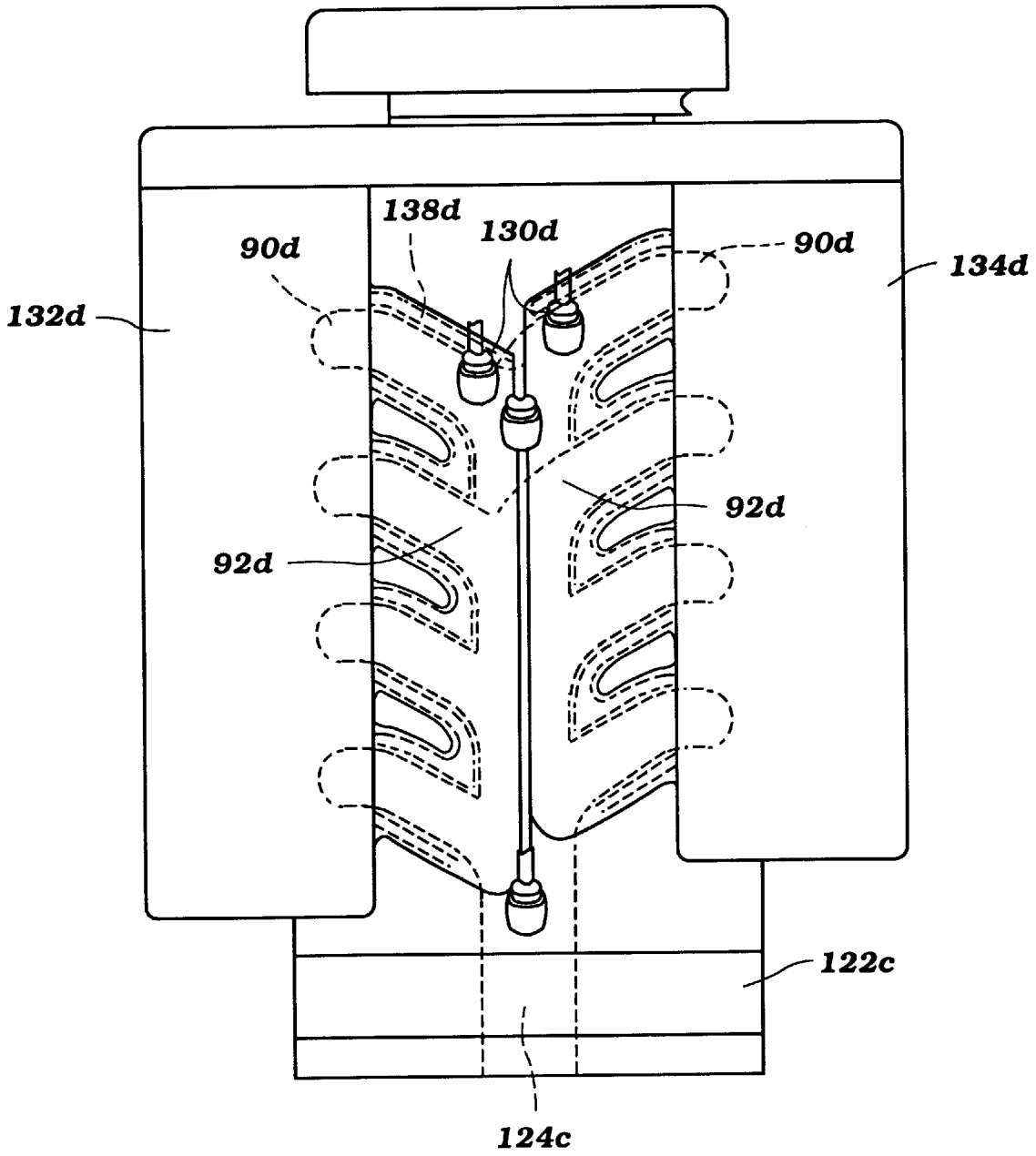
FIG. 10 is a front end view of the engine illustrated in FIG. 7 and illustrating an exhaust sensor mounting arrangement of the control of the present invention when the engine has eight cylinders.

The arrangement illustrated in FIG. 9 is for an engine of the six-cylinder "V"-type. FIG. 10 illustrates a sensor arrangement for an engine having a similar exhaust system arrangement but where the engine is of the eight-cylinder "V"-type. In this embodiment, similar parts have been given like reference numerals to those used in the embodiment illustrated in FIG. 9, except that a "d" designator has been added thereto. In this arrangement, a sensor 130*d* may be positioned in similar positions to those described in conjunction with FIG. 9.

Figure 11:
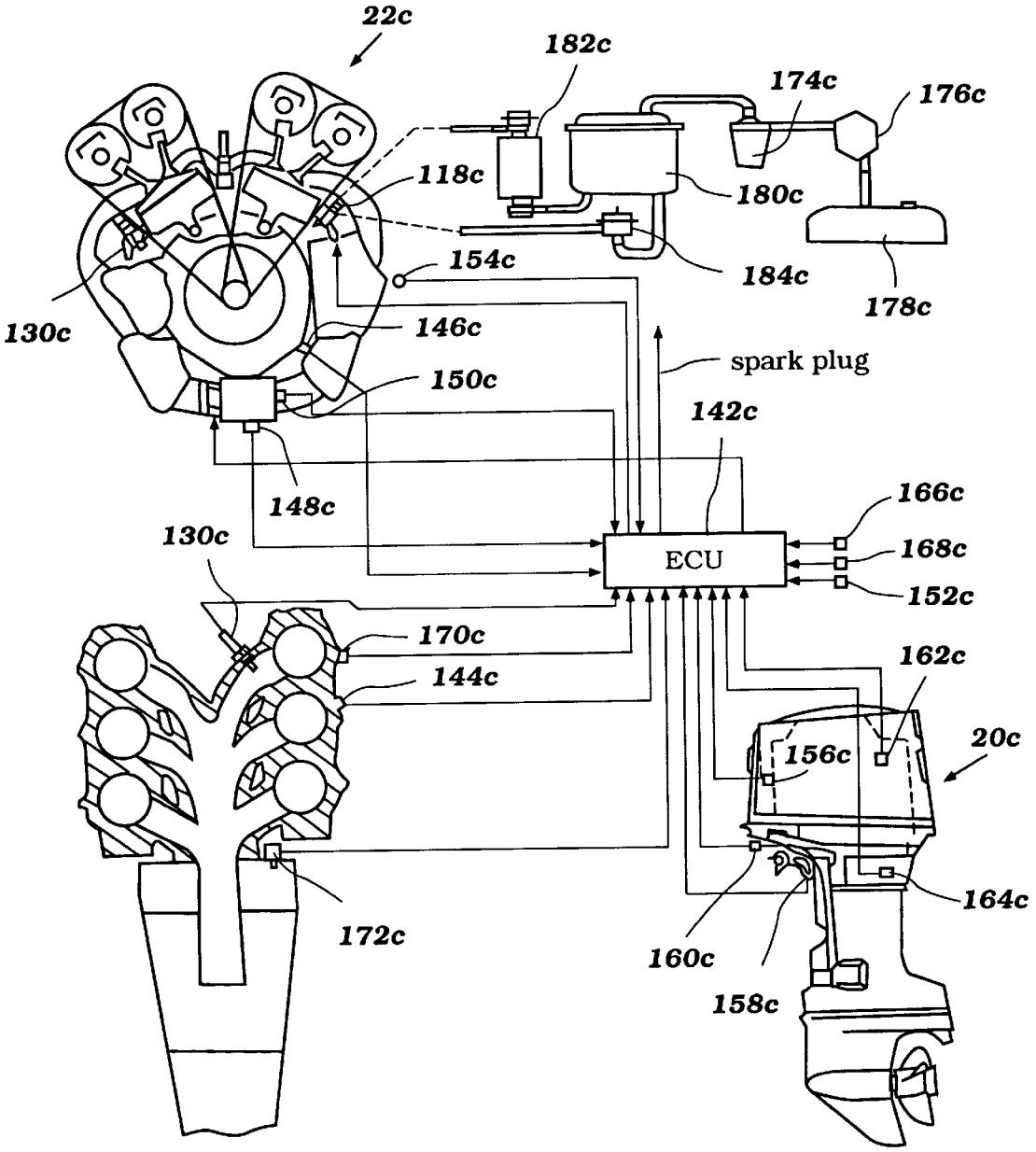
FIG. 11 is a schematic illustrating the interrelationship between the engine powering the motor illustrated in FIG. 4 or 7, various sensors for the engine and the motor, and the control of the present invention.

FIG. 11 illustrates schematically the control system of the present invention. This schematic illustrates the control system for the embodiment illustrated in FIGS. 8–9, wherein the engine is of the "V"-type, it being understood that the system applies equally to the other embodiments of the present invention.

Preferably, at least one exhaust sensor 130*c* is provided in the exhaust passage(s) in a manner as described in one of the embodiments above. Each sensor 130*c* provides a output signal to an ECU 142*c* indicative of the oxygen content of the exhaust gas, as described in detail above.

The ECU 142*c* also preferably receives data from other sensors. For example, an engine temperature sensor 144*c*, a crankshaft rotational position sensor 146*c*, an intake air temperature sensor 148*c*, a throttle position sensor 150*c*, an ambient air pressure sensor 152*c*, a combustion chamber pressure sensor 154*c*, an engine vibration sensor 156*c*, a motor trim position sensor 158*c*, a motor height sensor 160*c*, a cooling water temperature sensor 162*c*, a transmission position sensor 164*c*, a watercraft speed sensor 166*c*, a watercraft posture sensor 168*c*, an oil temperature sensor 170*c*, and an exhaust gas back pressure sensor 172*c*.

As fuel system for providing fuel to the engine 22*c* is further illustrated in this figure. As illustrated, fuel is delivered through a filter 174*c* by a low pressure fuel pump 176*c* from a fuel source or tank 178*c* to a vapor separator 180*c*. Fuel is then pumped from the vapor separator 180*c* by a high pressure pump 182*c* and delivered to each fuel injector 118*c*. Fuel supplied to the injector 118*c* but not delivered into the combustion chamber is returned through a return line to the vapor separator 180*c*. A pressure regulator 184*c* is provided along the return line to ensure that the pressure of the fuel supplied by the high pressure pump 182*c* to the fuel injector 118*c* remains high.

The ECU 142*c* utilizes the data from the various sensors and controls various aspects engine operating features. For example, the ECU 142*c* controls the timing of the firing of spark plugs or other spark initiating elements. The ECU 142*c* also controls the fuel injector 118*c*, thus controlling the amount of fuel delivered to the engine, and thus the ratio of the air/fuel charge. In this manner, the ECU 142*c* ensures that the engine is operating at the correct operating parameters for a given condition.

The control system of the present invention has the advantage that the exhaust gas sensor(s) thereof are arranged to provide reliable data regarding the combustion condition of the engine. In this manner, the feedback control is effective in providing the engine with an air/fuel ratio which is optimum for the engine's running conditions.

Of course, the foregoing description is that of preferred embodiments of the invention, and various changes and modifications may be made without departing from the spirit and scope of the invention, as defined by the appended claims.

What is claimed is:

1. An outboard motor having a power head and a lower unit extending therebelow, an internal combustion engine positioned within a cowling of the power head and having an output shaft extending generally vertically downward to said lower unit and arranged in driving relationship with a water propulsion device of the motor, the engine operating on a four-cycle principle and having at least one combustion chamber, an air/fuel charging system for delivering air and fuel into said combustion chamber for combustion therein, and an exhaust system including an exhaust passage leading from said chamber to a generally vertically extending main exhaust passage, said main exhaust passage extending to an exhaust guide positioned below said engine, an exhaust passage leading through said exhaust guide from said main exhaust passage to an expansion chamber positioned within said lower unit, and an exhaust gas discharge provided from said expansion chamber, and a feedback control for adjusting the ratio of air and fuel supplied to said combustion chamber, said feedback control including a combustion condition sensor mounted to sense exhaust gas flowing through that portion of said exhaust system above said exhaust guide.

2. The outboard motor in accordance with claim 1, wherein said engine has multiple combustion chambers arranged vertically, and wherein said combustion condition sensor is positioned in an exhaust passage corresponding to a top combustion chamber.

3. The outboard motor in accordance with claim 1, wherein said engine has multiple combustion chambers arranged vertically, and wherein said combustion condition sensor is positioned in an exhaust passage corresponding to a bottom combustion chamber.

4. The outboard motor in accordance with claim 1, wherein said combustion condition sensor is mounted to sense exhaust gases flowing generally directly at said sensor.

5. The outboard motor in accordance with claim 1, wherein at least one combustion condition sensor is mounted to sense exhaust gas flowing through said main exhaust passage.

6. The outboard motor in accordance with claim 5, wherein said sensor is mounted at a top end of said main exhaust passage.

7. The outboard motor in accordance with claim 5, wherein said sensor is mounted at a bottom end of said main exhaust passage above said exhaust guide.

8. The outboard motor in accordance with claim 1, wherein said combustion chamber is defined by a cylinder head connected to a cylinder block, and wherein said exhaust passage extends through said cylinder head and said combustion condition sensor is mounted to said cylinder head.

9. The outboard motor in accordance with claim 1, wherein said engine is of the "V"-type having a cylinder block with a first cylinder head connected thereto and defining a first bank containing at least one combustion chamber and a second cylinder head connected to said cylinder block and defining a second bank containing at least one combustion chamber.

10. The outboard motor in accordance with claim 9, wherein said exhaust passage leading from each combustion chamber extends through said first or second cylinder head.

11. The outboard motor in accordance with claim 9, wherein said exhaust system includes a common exhaust passage leading through a valley of said engine between said cylinder banks and into which exhaust gas flows from each exhaust passage, and at least one combustion condition sensor is arranged to sense exhaust gas flowing through said common passage.

12. An outboard motor having a power head and a lower unit extending therebelow, an internal combustion engine positioned within a cowling of the power head and having an output shaft extending generally vertically downward to said lower unit and arranged in driving relationship with a water propulsion device of the motor, the engine operating on a four-cycle principle and having at least two vertically arranged combustion chambers thereby defining a top chamber and a bottom chamber, an air/fuel charging system for delivering air and fuel into said combustion chamber for combustion therein, and an exhaust system including an exhaust passage leading from said chamber to a generally vertically extending main exhaust passage, said main exhaust passage extending to an exhaust guide positioned below said engine, an exhaust passage leading through said exhaust guide from said main exhaust passage to an expansion chamber positioned within said lower unit, and an exhaust gas discharge provided from said expansion chamber, and a feedback control for adjusting the ratio of air and fuel supplied to said combustion chamber, said feedback control including a combustion condition sensor mounted to sense exhaust gas flowing through the portion of said exhaust system above said exhaust guide.

13. The outboard motor in accordance with claim 12, wherein said engine has a first bank containing at least two combustion chambers and a second bank containing at least two combustion chambers.

14. The outboard motor in accordance with claim 13, wherein a first main exhaust passage is provided corresponding to said first bank and a second main exhaust passage is provided corresponding to said second bank and a combustion condition sensor is mounted in said first and second main exhaust passages.

15. The outboard motor in accordance with claim 12, wherein said combustion condition sensor is mounted at a connecting point of a top of said exhaust passages with said main exhaust passage.

16. The outboard motor in accordance with claim 12, wherein said combustion condition sensor is mounted at a connecting point of a bottom of said exhaust passages with said main exhaust passage.

17. The outboard motor in accordance with claim 12, wherein said combustion condition sensor is mounted at a top end of said main passage.

18. The outboard motor in accordance with claim 12, wherein said combustion condition sensor is mounted at a bottom end of said main passage above said exhaust guide.

* * * * *